US005823442A

United States Patent [19]

Guo

[11] Patent Number: 5,823,442

[45] Date of Patent: Oct. 20, 1998

[54] SPRAY NOZZLE

[76] Inventor: Wen-Li Guo, No. 10, Fang Dong Road, Wen Gin Tsuen, Fang Yuan Hsiang, Chang Hua Hsien, Taiwan

[21] Appl. No.: 635,559

[22] Filed: Apr. 22, 1996

[51] Int. Cl.[6] ..... A62C 31/02; B05B 1/12

[52] U.S. Cl. ..... 239/394

[58] Field of Search ..... 239/390, 391, 239/392, 394, 436, 443, 444, 446, 447, 540

[56] References Cited

U.S. PATENT DOCUMENTS 3,377,028 4/1968 Bruggeman ..... 239/394
4,666,085 5/1987 Liaw ..... 239/394
4,903,897 2/1990 Hayes ..... 239/394
5,566,886 10/1996 Wang ..... 239/394

*Primary Examiner*—Andres Kashnikow
*Assistant Examiner*—Robin O. Evans
*Attorney, Agent, or Firm*—Charles E. Baxley, Esq.

[57] ABSTRACT

A spray nozzle includes a rod extended from a casing which has two inlets. A follower is rotatably engaging with the rod and has a barrel aligned with one inlet and has one or more cylindrical members aligned with the other inlet. A board and a cap are secured to the rod. A control ferrule may rotate the follower and the disc to align either of the inlets with the barrel and the cylindrical members. The water is allowed to flow out through a peripheral gap formed between the control ferrule and the cap. The spray nozzle includes a greatly simplified configuration.

3 Claims, 3 Drawing Sheets

SPRAY NOZZLE

BACKGROUND OF THE INVENTION

1. Field of the Invention

The present invention relates to a nozzle, and more particularly to a multiple pattern spray nozzle.

2. Description of the Prior Art

Typical spray nozzles comprise a control barrel rotatably secured to a head and having a number of outlets selectively engaged with a water passage of the head so as to form different spray water outlet patterns. One type of the spray nozzles is disclosed in U.S. Pat. No. 4,666,085 to Liaw. However, the typical spray nozzle comprises a complicated configuration.

The present invention has arisen to mitigate and/or obviate the afore-described disadvantages of the conventional water spray nozzles.

SUMMARY OF THE INVENTION

The primary objective of the present invention is to provide a spray nozzle having a greatly simplified configuration.

In accordance with one aspect of the invention, there is provided a spray nozzle comprising a casing including a mouth for connecting the casing to a water reservoir, the casing including a rod extended therefrom, the rod including a free end, a plate secured to the casing and including a center portion engaged on the rod, the plate including a first inlet and a second inlet, the second inlet being arranged closer to the center portion of the plate than the first inlet, a follower including a center portion rotatably engaging with the rod and including a barrel for aligning with the second inlet and including at least one first cylindrical member for aligning with the first inlet, a disc secured to the follower and rotatably engaging with the rod, the disc including an opening for engaging with the barrel and including at least one orifice for engaging with the first cylindrical member, a board secured to the free end of the rod and including a protrusion having at least one passage formed therein, the protrusion being allowed to be aligned with the opening, the board including an entrance for aligning with the orifice, a cap including a peripheral portion secured to the board and including a plurality of punctures formed therein, the cap including an outlet for aligning with the entrance and for aligning with the orifice, and a control ferrule including a peripheral portion secured to the follower so as to rotate the follower and the disc. The follower and the disc are rotated by the control ferrule so as to align the second inlet with the barrel and so as to align the first inlet with the first cylindrical member, the water contained in the casing is allowed to flow out of the punctures of the cap when the protrusion is aligned with the opening and the barrel and the second inlet, and the water is allowed to flow out of the orifice when the outlet of the cap and the entrance and the first inlet are aligned with the first cylindrical member.

The plate includes a hole formed therein for receiving projection means, the projection means includes a ball and a spring for biasing the ball to engage with the follower so as to position the follower relative to the casing.

The follower includes a peripheral wall having a plurality of notches formed therein, the control ferrule includes a peripheral flange and includes a peripheral gap formed between the peripheral flange of the control ferrule and the cap and communicating with the notches of the follower, the follower includes a second cylindrical member for aligning with the first inlet, the second cylindrical member including a plurality of slits formed therein for allowing water to flow into the follower when the second cylindrical member is aligned with the first inlet, and for allowing the water to flow out through the peripheral gap.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
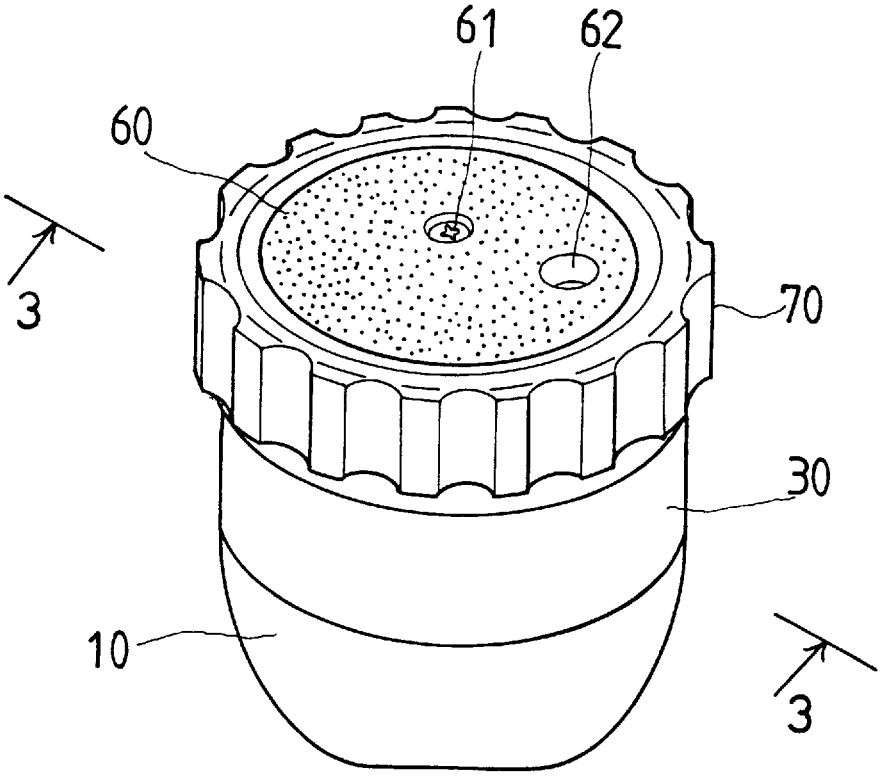
FIG. 1 is a perspective view of a spray nozzle in accordance with the present invention.
Figure 2:
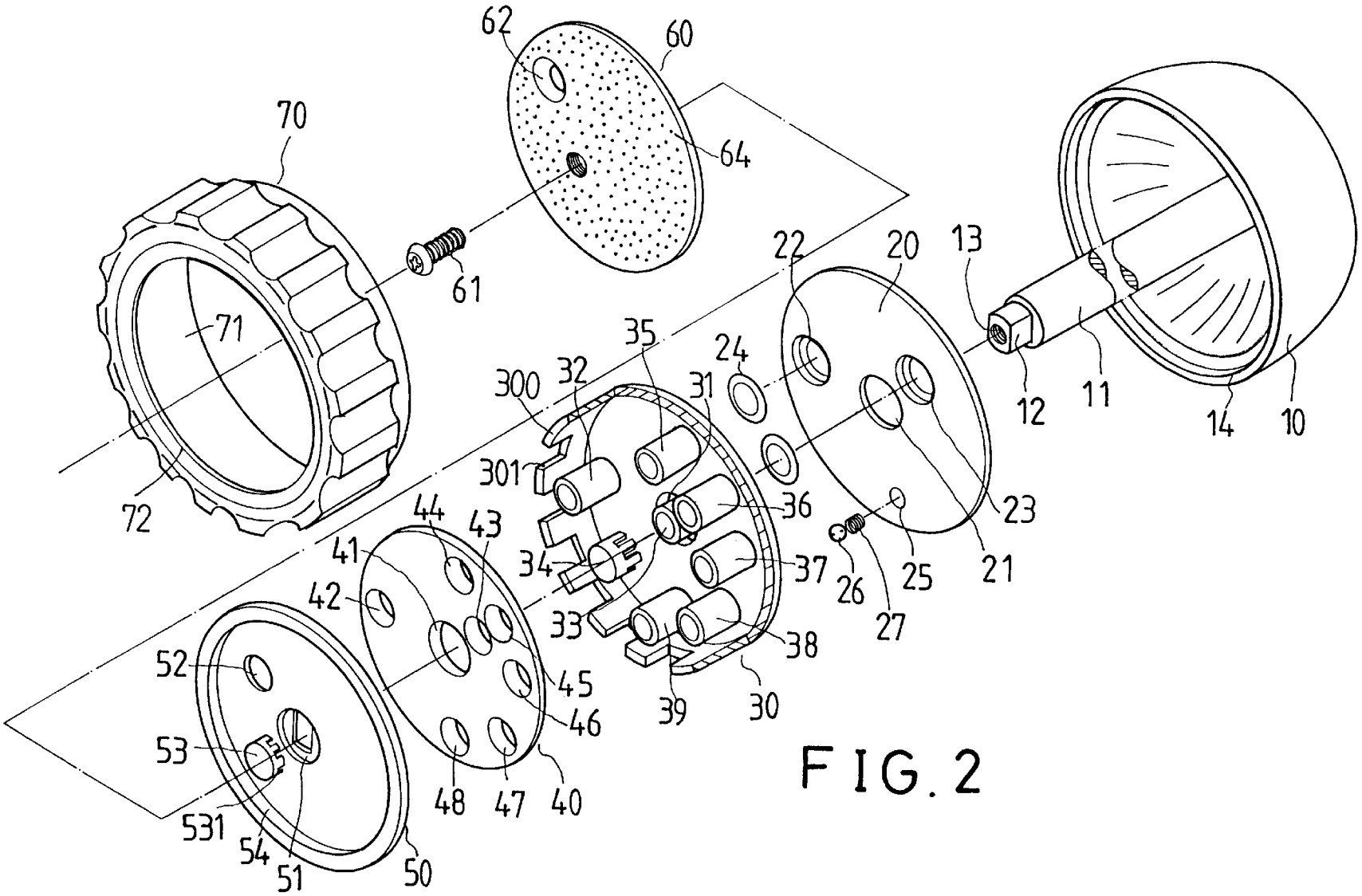
FIG. 2 is an exploded view of the spray nozzle.

Referring to the drawings, a spray nozzle device in accordance with the present invention comprises a casing 10 having a chamber formed therein and having a mouth 15 and two orifices 16 for connecting the chamber of the casing 10 to a water reservoir. The casing 10 includes an upper peripheral portion having an annular shoulder 14 formed therein and includes a rod 11 extended from the bottom portion thereof. The rod 11 includes a non-circular free end 12 having a screw hole 13 formed therein.

A plate 20 includes a bore 21 engaged on the rod 11 and includes two inlets 22, 23 each having a sealing ring 24 engaged therein. It is to be noted that the inlet 23 is arranged closer to the bore 21 than the other inlet 22. The plate 20 includes a hole 25 formed therein for receiving a spring 27 and a ball 26. The plate 20 has a peripheral portion engaged with the annular shoulder 14 of the casing 10 and secured to the casing 10 by such as ultrasonic welding process.

Figure 3:
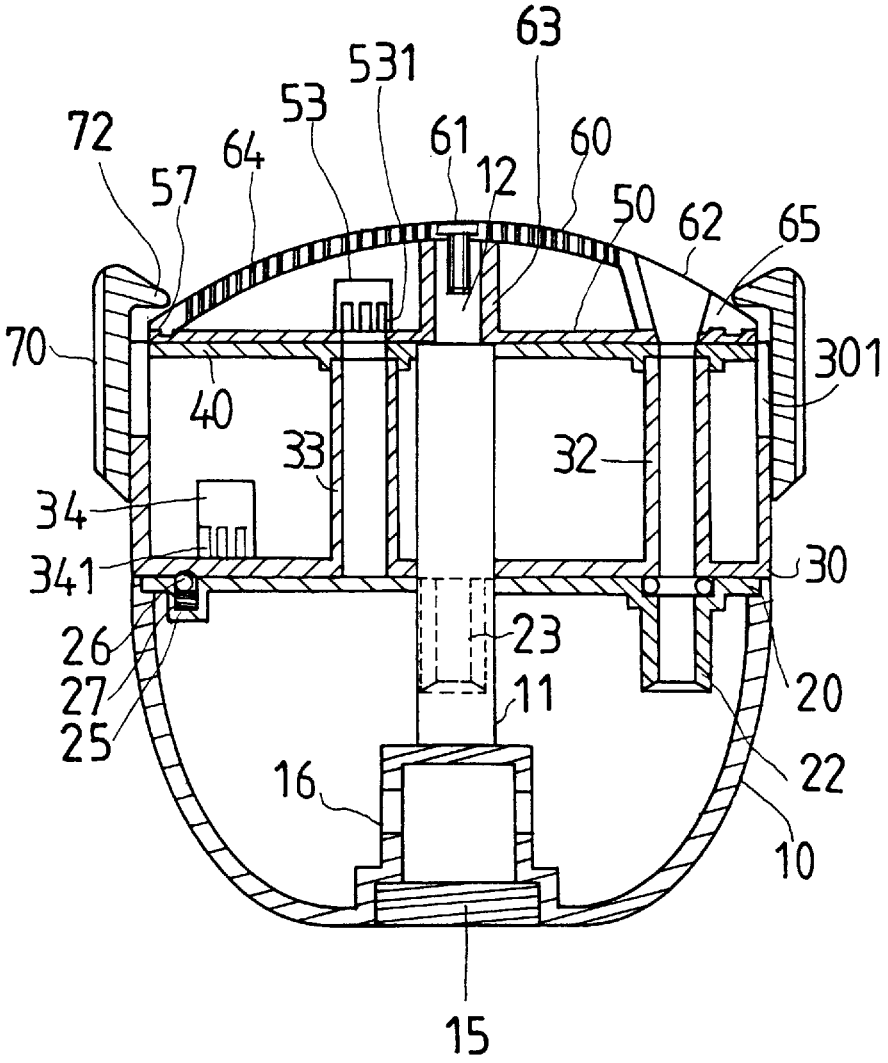
FIG. 3 is a cross sectional view taken along lines 3—3 of FIG. 1, illustrating the operation of the spray nozzle.

A follower 30 includes a hole 31 for engaging with the rod 11 and includes a peripheral wall 300 having a number of notches 301 formed therein, and includes a barrel 33 for aligning with the inlet 23, and includes a number of cylindrical member 32, 34, 35, 36, 37, 38, 39 for aligning with the inlet 22 respectively. The cylindrical member 34 includes an enclosed end and a number of slits 341 (FIG. 3) formed therein for allowing water to flow into the follower 30 when the cylindrical member 34 is aligned with the inlet 22. The ball 26 is biased to engage with the follower 30 so as to position the follower 30 (FIG. 3). A disc 40 is secured to and rotated in concert with the follower 30 and includes a bore 41 for engaging with the rod 11 and includes an opening 43 for engaging with the barrel 33, and includes a number of orifices 42, 44, 45, 46, 47, 48 for engaging with the cylindrical members 32, 35, 36, 37, 38, 39 respectively. It is to be noted that the orifices 42, 44, 45, 46, 47, 48 include an outlet hole of different shapes so as to form different types of water jets.

A board 50 includes a bore 51 for engaging with the non-circular free end 12 of the rod 11 so as to be rotated in concert with the rod 11 and the casing 10. The board 50 includes a protrusion 53 having a number of passages 531 formed therein. The protrusion 53 may be aligned with the opening 43. The board 50 includes an entrance 52 for aligning with either of the orifices 42, 44, 45, 46, 47, 48. The board 50 includes a peripheral shoulder 54 for engaging with the peripheral portion of a cap 60 which includes a number of punctures 64 formed therein. The cap 60 includes an outlet 62 aligned with the entrance 52 for aligning with either of the orifices 42, 44, 45, 46, 47, 48 (FIG. 3). A screw 61 may engage through the cap 60 and may engage with the screw hole 13 of the rod 11 so as to secure the cap 60 and the board 50 to the rod 11. The cap 60 is secured to the board 50 by ultrasonic welding process and secured to the rod 11. A control ferrule 70 includes a lower peripheral portion 71 secured to the peripheral portion of the follower 30 by ultrasonic welding process such that the follower 30 and the disc 40 may be rotated by the control ferrule 70. A peripheral gap 65 (FIG. 3) is formed between the upper peripheral flange 72 of the control ferrule 70 and the cap 60 and communicating with the notches 301 of the follower 30.

In operation, the follower 30 and the disc 40 may be rotated by the control ferrule 70 so as to align the inlet 23 with the barrel 33 or to align the inlet 22 with either of the cylindrical members 32, 34, 35, 36, 37, 38, 39. When the protrusion 53 is aligned with the opening 43 and the barrel 33 and the inlet 23, water from the mouth 15 of the casing 10 may flow out of the cap 60 via the punctures 64. When the cylindrical member 34 is aligned with the inlet 22, water from the inlet 22 may flow into the follower 30 and may flow out of the spray nozzle via the notches 301 of the follower 30 and the peripheral gap 65 formed between the control ferrule 70 and the cap 60. When the outlet 62 of the cap 60 and the entrance 52 and the inlet 22 are aligned with either of the cylindrical members 32, 35–39, the water from the inlet 22 may flow out of the orifices 42, 44–48 so as to form different types of water jets according to the different shapes of the orifices 42, 44–48.

Accordingly, the spray nozzle in accordance with the present invention includes a greatly simplified configuration that may be easily and quickly manufactured and that may be easily operated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A spray nozzle comprising:

a casing including a mouth for connecting said casing to a water reservoir, said casing including a rod extended therefrom, said rod including a free end, a plate secured to said casing and including a center portion engaged on said rod, said plate including a first inlet and a second inlet, said second inlet being arranged closer to said center portion of said plate than said first inlet, a follower including a center portion rotatably engaging with said rod and including a barrel for aligning with said second inlet and including at least one first cylindrical member for aligning with said first inlet, a disc secured to said follower and rotatably engaging with said rod, said disc including an opening for engaging with said barrel and including at least one orifice for engaging with said first cylindrical member, a board secured to said free end of said rod and including a protrusion having at least one passage formed therein, said protrusion being allowed to be aligned with said opening, said board including an entrance for aligning with said orifice, a cap including a peripheral portion secured to said board and including a plurality of punctures formed therein, said cap including an outlet for aligning with said entrance and for aligning with said orifice, and a control ferrule including a peripheral portion secured to said follower so as to rotate said follower and said disc, said follower and said disc being rotated by said control ferrule so as to align said second inlet with said barrel and so as to align said first inlet with said first cylindrical member, water contained in said casing being allowed to flow out of said punctures of said cap when said protrusion is aligned with said opening and said barrel and said second inlet, and the water being allowed to flow out of said orifice when said outlet of said cap and said entrance and said first inlet are aligned with said first cylindrical member.

2. A spray nozzle according to claim 1, wherein said plate includes a hole formed therein for receiving projection means, said projection means includes a ball and a spring for biasing said ball to engage with said follower so as to position said follower relative to said casing.

3. A spray nozzle according to claim 1, wherein said follower includes a peripheral wall having a plurality of notches formed therein, said control ferrule includes a peripheral flange and includes a peripheral gap formed between said peripheral flange of said control ferrule and said cap and communicating with said notches of said follower, said follower includes a second cylindrical member for aligning with said first inlet, said second cylindrical member including a plurality of slits formed therein for allowing water to flow into said follower when said second cylindrical member is aligned with said first inlet, and for allowing the water to flow out through said peripheral gap.

* * * * *